US005160970A

United States Patent [19]

Isogai

[11] Patent Number: 5,160,970

[45] Date of Patent: Nov. 3, 1992

[54] CONTROLLABLE FIXING DEVICE FOR FIXING A TONER IMAGE INTO A SHEET

[75] Inventor: Mitsuru Isogai, Toyokawa, Japan

[73] Assignee: Minolta Camera Kabushiki Kaisha, Osaka, Japan

[21] Appl. No.: 718,564

[22] Filed: Jun. 20, 1991

[30] Foreign Application Priority Data

Nov. 29, 1990 [JP] Japan ..... 2-335898
Nov. 29, 1990 [JP] Japan ..... 2-335899
Nov. 29, 1990 [JP] Japan ..... 2-335900

[51] Int. Cl.[5] ..... G03G 15/20; G03G 21/00

[52] U.S. Cl. ..... 355/284; 118/60; 355/282

[58] Field of Search ..... 355/282, 284, 285, 289, 355/290, 295, 203; 118/60

[56] References Cited

U.S. PATENT DOCUMENTS 4,045,165 8/1977 Nakajima et al. ..... 432/60
4,285,295 8/1981 Iwao et al. ..... 118/60
4,352,551 10/1982 Iwao ..... 355/284
4,549,803 10/1985 Ohno et al. ..... 355/284
4,593,992 6/1986 Yoshinaga et al. ..... 355/284
4,870,445 9/1989 Collier et al. ..... 355/282
4,905,049 2/1990 Bickerstaff et al. ..... 355/284
4,949,131 8/1990 Ito ..... 355/282
5,014,406 5/1991 Kato et al. ..... 29/130
5,051,780 9/1991 Stelter et al. ..... 355/285 X
5,061,965 10/1991 Ferguson et al. ..... 355/284

FOREIGN PATENT DOCUMENTS 54-35941 11/1979 Japan .
1-244488 9/1989 Japan .

OTHER PUBLICATIONS

Technical Disclosure No. 90-10943, vol. 15-36 (581), *JIII Journal Of Technical Disclosure*, Jun. 20, 1990.

*Primary Examiner*—A. T. Grimley
*Assistant Examiner*—Sandra L. Brase
*Attorney, Agent, or Firm*—Burns, Doane, Swecker & Mathis

[57] ABSTRACT

A press cam is driven when fixing rollers are rotated for a warm-up operation at the time the power is applied simultaneously with the timing a recording material is fed to a fixing roller whereby an oil coating roller is controlled to be brought in contact with and moved away from the fixing rollers. Oil is coated on the fixing rollers for only a predetermined period of time during the fixing rollers are rotated at the warm-up operation which correspond to the time until the recording material reaches the fixing rollers.

40 Claims, 11 Drawing Sheets

CONTROLLABLE FIXING DEVICE FOR FIXING A TONER IMAGE INTO A SHEET

BACKGROUND OF THE INVENTION

1. Technical Field of the Invention

The present invention relates to a fixing device for fixing a toner image onto a sheet, and more particularly, to a fixing device which is provided with a pair of fixing rollers.

2. Description of Related Art

An electrophotographic copying machine and printer are provided with a fixing device for fixing a toner image transferred from a photoconductor onto a sheet. Generally, the machine which is provided with a pair of fixing rollers is known. A heater is housed at least in one of the pair of fixing rollers, wherein a toner image on a sheet which passes through a nip section between the pair of rollers is heated and fused by the heater and fixed onto the sheet.

In such a conventional fixing device, a mold releasing agent coating structure for coating a mold releasing agent or offset-preventive agent on the fixing rollers is provided to prevent toner from being offset to the fixing rollers. The mold releasing agent coating structure is provided with a coating roller for coating the mold releasing agent on the fixing rollers. The coating roller is movably provided toward and away from the fixing rollers in order to avoid wasteful consumption of the mold releasing agent. However, it sometimes happens that an excessive mold releasing agent is coated on the fixing rollers when the coating roller is brought in contact with the fixing rollers even if the coating roller is arranged to be movable toward and away from the fixing rollers.

On the other hand, when a light transmissible colored toner image is fixed onto a transparent film (hereinafter called as OHP film) which is generally used as an original for overhead projectors, it is necessary to fully raise light transmissibility of a fixed image which necessitate to smooth the surface of the fixing rollers as much as possible. Accordingly, in the copying machines and printers which use a light transmissible colored toner, fixing rollers whose surfaces are substantially as smooth as mirror plane are used.

Incidentally, a member such as a thermistor for detecting a temperature is brought in contact with the surface of the fixing rollers. When such a member is brought in contact with the fixing rollers whose surfaces are substantially as smooth as mirror plane, an abnormal sound is generated and/or the fixing rollers are damaged by a friction between the fixing rollers and the member when the mold releasing agent is insufficient. Such troubles easily occur when the fixing device is warmed up immediately after the power is turned on.

In U.S. Pat. No. 4,549,803, there is disclosed a fixing device which is arranged to decrease a rotational speed of fixing rollers less than an ordinary operation when a colored toner is fixed on an OHP film. This is because the toner has to be fully fused when the colored toner is fixed onto the OHP film.

In an electrophotographic copying machine and printer, a sheet is transported at a speed equal to the rotational speed of a photoconductor when a toner image is transferred onto the sheet from the photoconductor. At this time, fixing rollers are also rotated at the same speed as the sheet is transported. Then, the rotational speed of the fixing rollers is changed immediately before the sheet reaches the fixing rollers.

When an OHP film is used, however, trouble sometimes occurs without having the OHP film thrusting into the nip section between a pair of rollers. After thorough study on the cause of the trouble, it was found that the OHP film slips on the fixing rollers. Such a trouble easily occurs especially when a rotating action of the fixing rollers is not stabilized immediately after rotational speed of the fixing rollers is changed. The OHP film tends to be obstructed when it thrusts into the fixing rollers until the rotational speed of the fixing rollers is sufficiently lowered.

SUMMARY OF THE INVENTION

It is a primary object of the present invention to provide a fixing device which is arranged to feed an adequate amount of a mold releasing agent to fixing rollers with an appropriate timing.

Another object of the present invention is to provide a fixing device which is capable of satisfactorily fixing colored toner onto an OHP film.

These and other objects and features of the present invention will become more apparent from the following description taken in conjunction with the accompanying drawings which illustrate specific embodiments of the invention.

DESCRIPTION OF THE PREFERRED EMBODIMENTS

An embodiment of the present invention will now be described hereinafter referring to the accompanying drawings.

Figure 1:
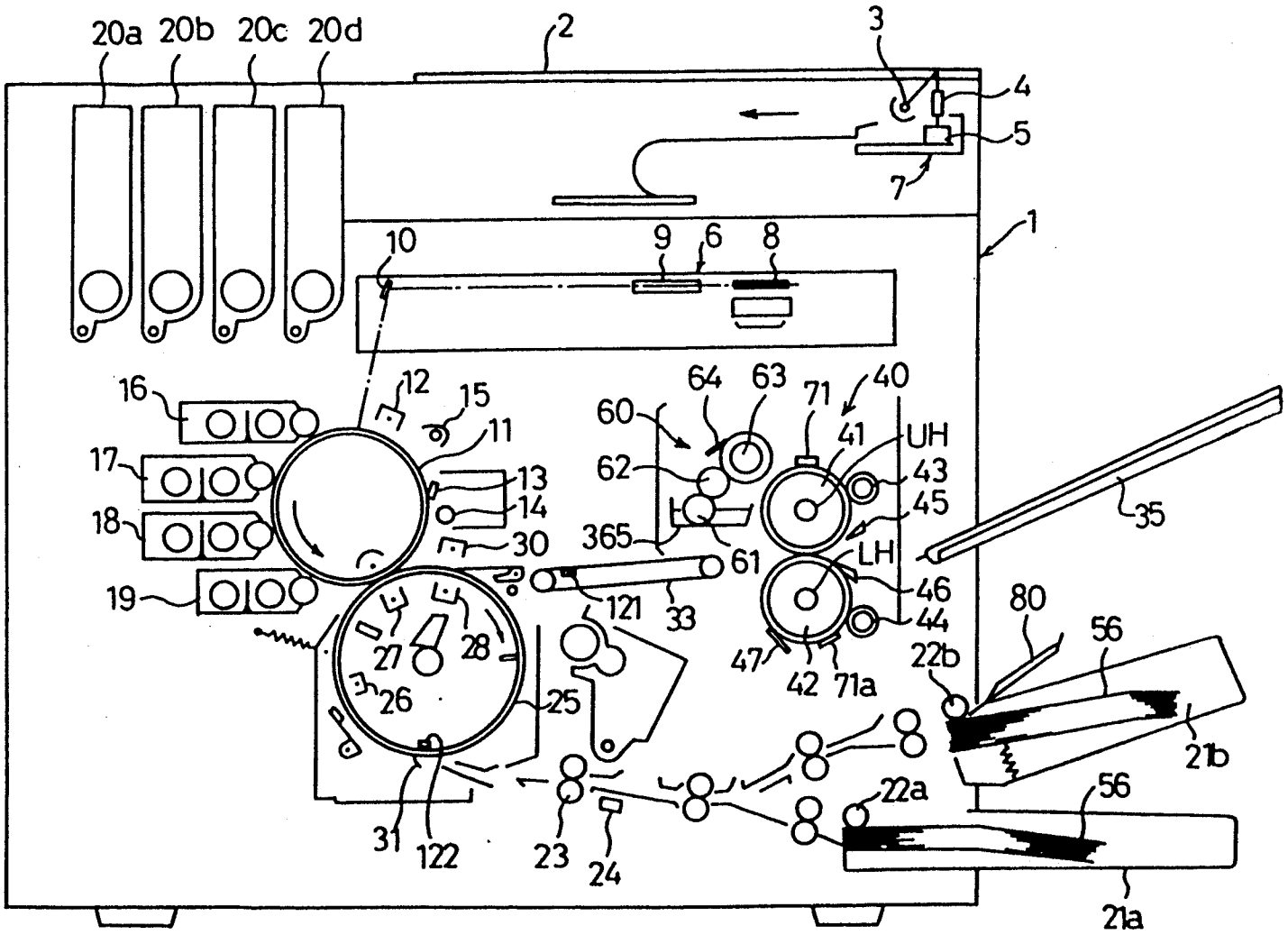
FIG. 1 is a schematic structural view showing a color copying machine provided with a fixing device to which the present invention is applied.

FIG. 1 shows a color copying machine 1 provided with a fixing device to which the present invention is applied. An original placed on an original glass table 2 is exposed to a CCD line sensor 5 by an exposure lamp 3 and a lens array 4, and is read as color signal. The color signals are converted into signals of Y (yellow), M (magenta), and C (cyan) or with an addition of K (black). The copying machine 1 in the present embodiment is not provided with image memory for three colors, and therefore, an image reader unit 7 repeats scanning operations every time each color image is formed basing on which signals of Y, M, C or Y, M, C, K are sequentially transmitted to a laser optical system 6. The laser optical system 6 is provided with a polygon mirror 8, an fθ lens 9 and a reflective mirror 10, and irradiate a modulated laser light based on said signals of Y, M, C or Y, M, C, K toward a photoconductive drum 11 for exposure.

Around the photoconductive drum 11, there are provided a cleaner 13, toner collecting roller 14, an eraser lamp 15 and a charger 12 with four kinds of developing units. The photoconductive drum 11 is negatively charged by the charger 12. The first developing unit 16 is provided for feeding a light transmissible cyan toner, the second developing unit 17 magenta toner, the third developing unit 18 yellow toner and the fourth developing unit 19 black toner respectively, and all these light transmissible toners are negatively charged. The toners are replenished to each developing unit 16–19 through toner transporting pipes (not illustrated) from each toner hopper 20*a*–20*d* where each colored toner is accommodated corresponding to the developing units.

Recording materials 56 such as plain paper, OHP film are either stacked in paper feed cassettes 21*a*, 21*b* or set one sheet by one sheet in a manual inserting tray 80, and are fed into the copying machine 1 one sheet by one sheet by paper feed rollers 22*a*, 22*b*. When the leading end of the recording material 56 comes in contact with a register roller 23, the recording material 56 is temporarily stopped to measure the following operation timing and correct skews at the same time. A paper sensor 24 is utilized for this purpose. The paper sensor 24 is provided with a movable piece which is acted by the leading end of the recording material 56 in order to detect a transparent OHP film.

A transfer drum 25 is provided in a transfer section for sequentially transferring each toner image of C, M, Y, K formed on the photoconductive drum 11 onto the recording material 56 and is rotatively driven in the direction of arrow. The transfer drum 25 is provided with a chucking claw 31 at its outer circumference for holding the recording material 56, and inside the drum 25, there are provided a sucking charger 26, a transfer charger 27, and a separation charger 28. Outside the transfer drum 25, a separation charger 30 is disposed opposite to the separation charger 28.

The recording material 56 fed from the register roller 23 is held by the chucking claw 31 provided on the transfer drum 25 and is electrostatically wound around the transfer drum 25 by the sucking charger 26 with rotation of the transfer drum 25. When the recording material 56 passes through the location between the transfer charger 27 and the photoconductive drum 11, a visualized toner image formed on the photoconductive drum 11 is transferred onto the recording material 56.

In the case when a colored image is reproduced, three or four rounds of transfer processes are sequentially conducted onto the recording material 56 by the transfer drum 25. The charge on the recording material 56 which has completed the transfer process is removed by the separation chargers 28, 30, and is separated from the transfer drum 25 to be transported to a fixing device 40 by a transport belt 33.

The fixing device 40 comprises an upper fixing roller 41, lower fixing rollers 42, cleaning rollers 43, 44, an oil coating unit 60, separation claws 45, 46, an oil collecting braid 47 and the like. The toner image formed on the recording material 56 is heated and pressed by the upper and lower fixing rollers 41, 42 to be fixed onto a recording material 56 and is then discharged onto a discharge tray 35.

The upper fixing roller 41 and the lower fixing roller 42 incorporate a heater UH and a heater LH respectively for heat fusing operations. The surface of the upper fixing roller 41 is provided with a layer of an elastic body and is made substantially as smooth as mirror plane. Reference numerals 71 and 71*a* represent thermistors positioned adjacent to the upper fixing roller 41 and the lower fixing roller 42 for detecting temperatures of the upper and lower fixing rollers 41, 42.

Figure 2:
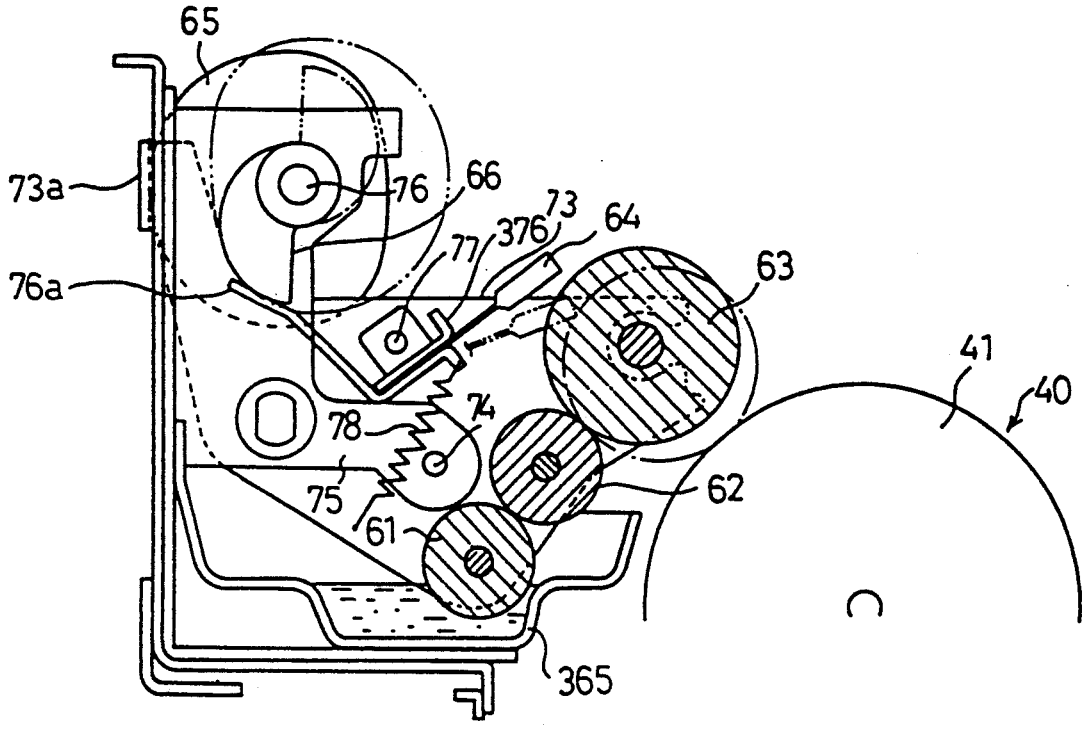
FIG. 2 is a transverse sectional view showing an oil coating structure of the fixing device.
Figure 3:
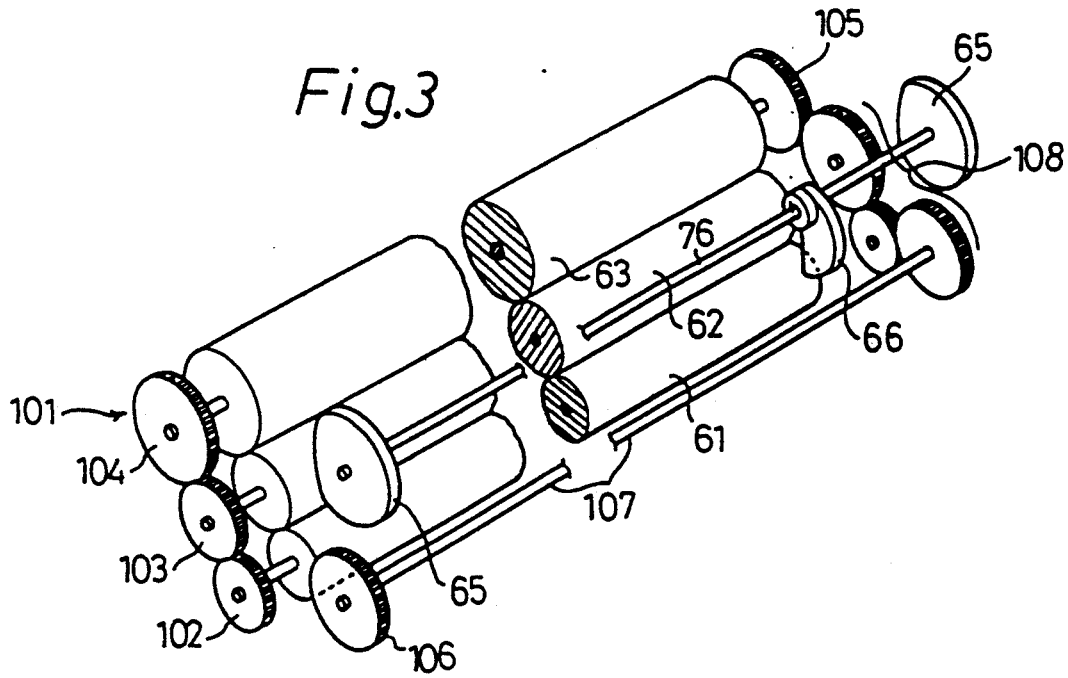
FIG. 3 is a perspective view showing a driving force transmitting system of the oil coating structure.

As illustrated in FIGS. 2 and 3, the oil coating unit 60 is provided for supplying a mold releasing agent onto the surface of the upper fixing roller 41, and it comprises oil feeding rollers 61, 62, an oil coating roller 63, an oil regulating blade 64 and the like. A silicone oil stored in a oil tank 365 as a mold releasing agent is sucked up onto the oil coating roller 63 by the oil feeding rollers 61, 62 and leveled uniformly to be an adequate amount for coating by the oil regulating blade 64. The oil coating roller 63 is controlled to be pressed on and separated from the upper fixing roller 41 by a press control cam 65 which is driven with a timing the recording material 56 is transported to the fixing device 40 and an initial timing the fixing rollers start rotation when the power is turned on. Oil feeding to the upper fixing roller 41 is thus controlled. The oil regulating blade 64 is also controlled to be pressed on and separated from the oil coating roller 63 by the press control cam 66 in order to prevent foreign substances from adhering to the blade 64. The oil coating roller 63 is supported by a swing frame 73 together with the oil feeding rollers 61, 62 which are provided for feeding oil to the oil coating roller 63, and the swing frame 73 is pivotally supported by a bracket 75 fixed by a shaft 74. The fixed bracket 75 rotatably supports the rotating shaft 76 of the press control cams 65, 66. The oil regulating blade 64 is pivotally supported by a shaft 77 to the swing frame 73 at the portion of its base frame 376.

The swing frame 73 and the base frame 376 are energized clockwise by a spring 78 which is activated between the frames as shown in FIG. 2, and their respective passive pieces 73, 76*a* are pressed in contact with the press control cams 65, 66. The swing frame 73 and the base frame 376 are thus driven by the passive pieces 73, 76*a*. Accordingly the cam 65 moves the oil coating roller 63 toward and away from the upper fixing roller 41. While, the cam 66 moves the oil regulating blade 64 toward and away from the upper fixing roller 41.

Figure 4:
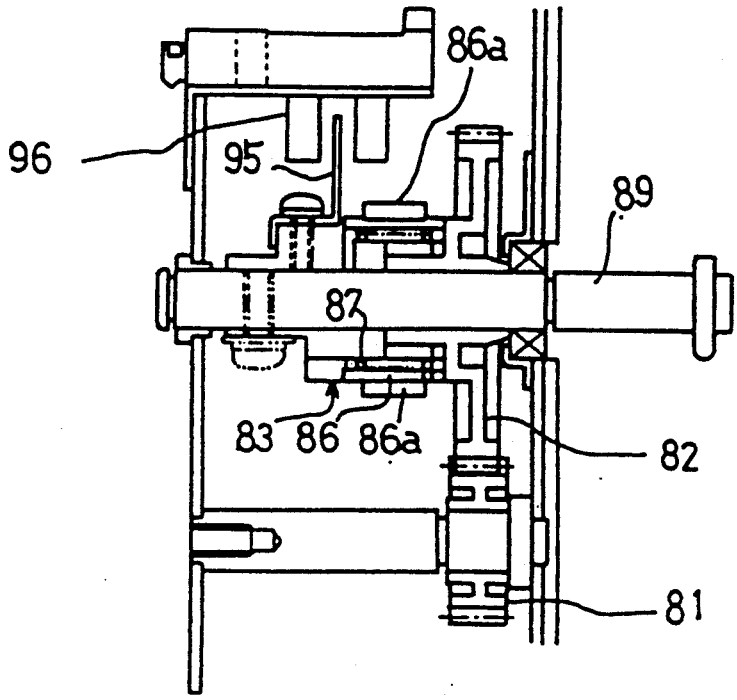
FIG. 4 is a cross-sectional view showing a driving force connecting and disconnecting mechanism of the oil coating structure.
Figure 5:
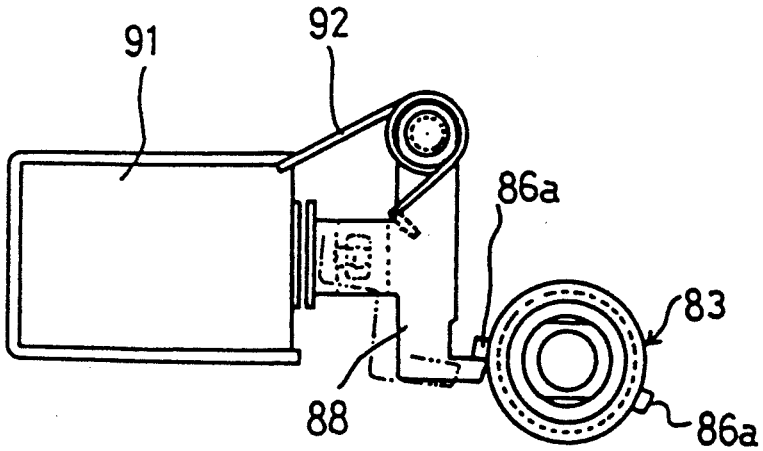
FIG. 5 is a side view showing a connecting and disconnecting operating mechanism of the driving force connecting and disconnecting structure.

The press control cams 65, 66 are operated by a cam operation control mechanism shown in FIGS. 4 and 5. A driving force from an unillustrated motor is transmitted to a spring clutch 83 through gears 81, 82. A normal closed type clutch is used for the spring clutch 83. In the clutch 83, an external cylinder 86 which is provided with claws 86*a* on two locations of the outer circumference is connected to one end of a spring 87, and when the claw 86a is engaged with a clutch control claw 88, the rotation of the gear 82 can not be transmitted to a cam driving shaft 89, in other words, it is under an off state.

When a solenoid 91 is turned on and the clutch control claw 88 is rotatively driven against a spring 92 to release the engagement with the claw 86a, the spring 87 is immediately wound tightly to become an on state for transmitting the rotation of the gear 82 to the driving shaft 89. Since the solenoid 91 is turned off immediately thereafter, the clutch control claw 88 is immediately returned to the position of engagement with the claw 86 by the energy of the spring 92. Accordingly, the spring clutch 83 rotates the cam driving shaft 89 one half turn by the rotation of the main motor every time the solenoid 91 is turned on.

The position shown by a solid line in FIG. 2 shows an off state under which the oil coating roller 63 is separated from the upper fixing roller and the oil regulating blade 64 is separated from the oil coating roller 63. Under the state, when the solenoid 91 is turned on, the press control cams 65, 66 are rotated one half turn to the position shown by phantom line, and the press cam 66 causes to press the oil regulating blade 64 onto the oil coating roller 63. Then, the press control cam 65 causes to press the oil coating roller 63 onto the upper fixing roller 41. The amount of oil in the oil coating roller 63 fed from the oil feeding rollers 61, 62 is thereby regulated by the oil regulating blade 64, and then, the oil coating roller 63 is pressed in contact with the upper fixing roller 41 for coating oil on the upper fixing roller 41. When the oil coating roller 63 is pressed in contact with the upper fixing roller 41, it is confirmed by a positing detecting sensor 96 whereby a position indicating pierce 95 provided on the cam driving shaft 89 is detected.

Under the sate that the oil coating roller 63 is in contact with the upper fixing roller 41, when the solenoid 91 is turned on again, the cams 65, 66 are rotated one half turn to the original position of the solid line from the position of the phantom line shown in FIG. 2. The cam 65 separates the oil coating roller 63 from the upper fixing roller 41, and then, the cam 66 separates the oil regulating blade 64 from the oil coating roller 63.

Figure 12:
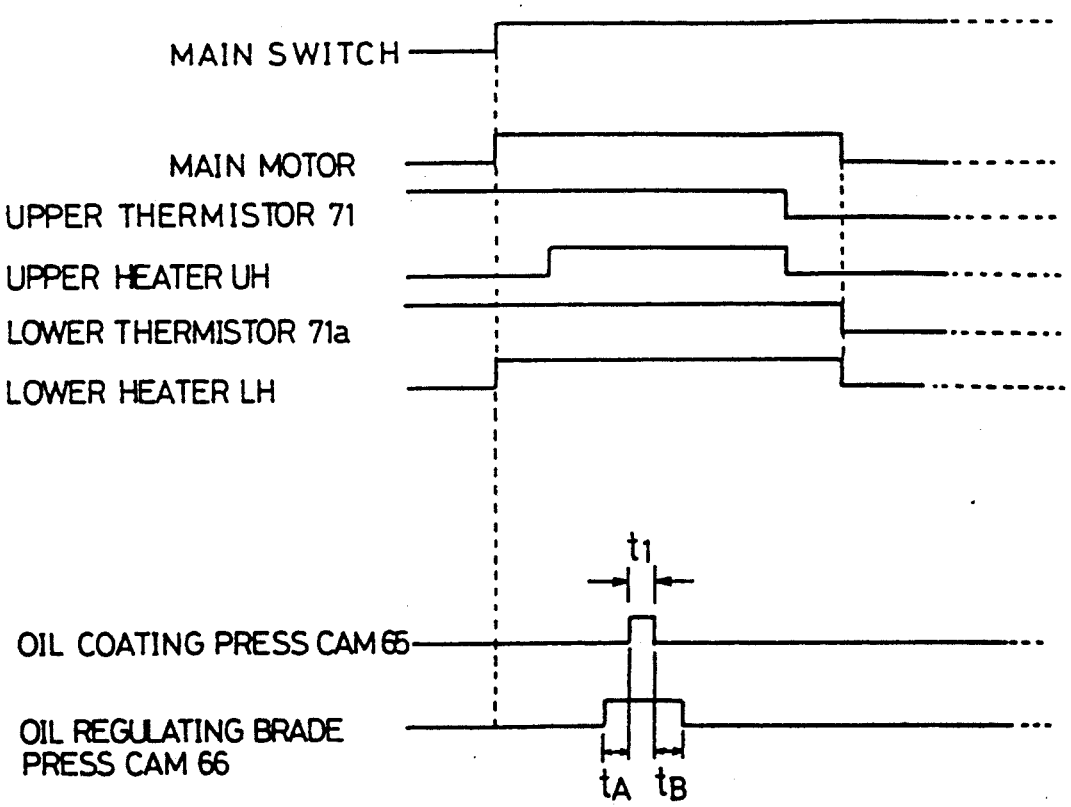
FIG. 12 is a time chart showing a typical action of a fixing device.
Figure 13:
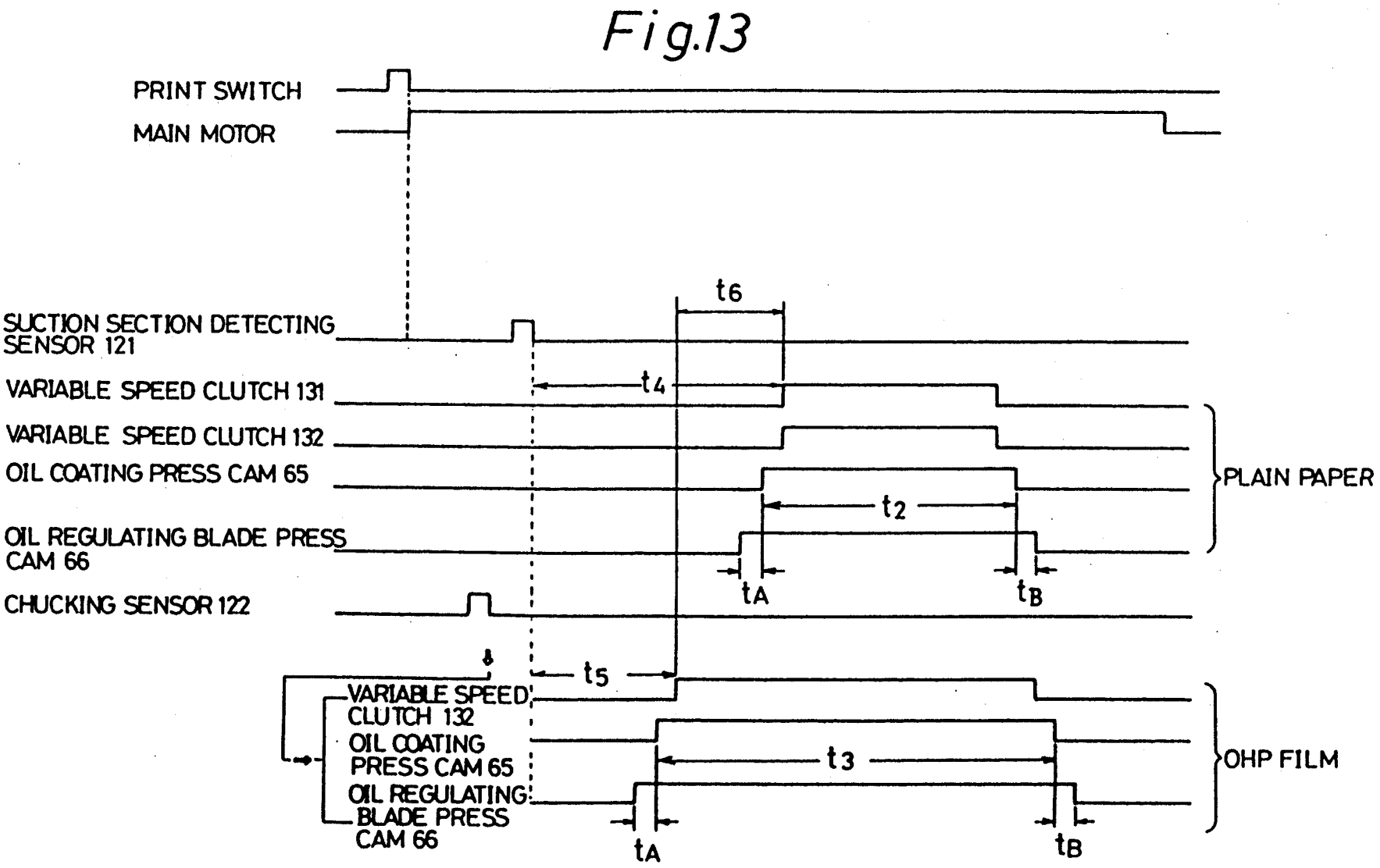
FIG. 13 is a time chart showing actions of a fixing device related to the present invention.
Figure 14:
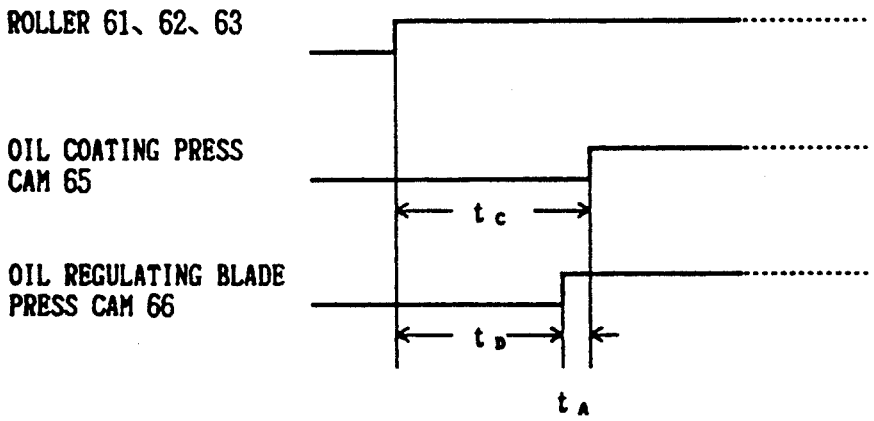
FIG. 14 is a time chart showing a sample of a part of another driving timing of oil feeding rollers and an oil coating roller.

Oil coating onto the upper fixing roller 41 by the oil coating roller 63 is performed during a warm-up time immediately after power is turned on (refer to FIG. 12) and when a toner image is fixed onto a recording material (refer to FIG. 13). Oil coating during the warm-up time serves to reduce friction between a rotating upper fixing roller 41 and the thermistor 71. Immediately after power is turned on, the temperature of the upper fixing roller 41 is low, and therefore, the oil impregnated in the upper fixing roller 41 does not bleed out. Accordingly, the surface of the upper fixing roller 41 which is highly smooth and possesses elasticity closely contacts the thermistor 71 to make a greater friction therebetween. The friction causes to generate an abnormal sound and the surface of the upper fixing roller 41 is damaged. The oil coating during the warm-up time solves such troubles.

More particularly, as illustrated by a time chart in FIG. 12, when the main switch is turned on and the power is applied to a copying machine, the main motor is started to rotate. By the rotation of the main motor, the fixing rollers 41, 42 are rotated. Simultaneously, the heater LH of the lower fixing roller 42 is turned on to start a warm-up action. Subsequently, the heater UH of the upper fixing roller 41 is turned on. Since the thickness of the upper fixing roller 41 is thinner than that of the lower fixing roller 42, the warm-up time required for the upper fixing roller 41 is shorter than the warm-up time required for the lower fixing roller 42. After the heaters UH and LH are turned on, the oil regulating blade 64 is brought in contact with the oil coating roller 63 by an action of the cam 66. With rotation of the oil coating roller 63, the oil coating roller 63 is brought in contact with the upper fixing roller 41 by the cam 65 after sufficient time has passed for the surface regulated by the oil regulating blade 64 to reach the position opposite to the upper fixing roller 41. The oil coating process onto the upper fixing roller 41 by the oil coating roller 63 is performed for a predetermined time period of $t_1$, and then, the oil coating roller 63 is moved away from the upper fixing roller 41. After the oil coating roller 63 is separated from the upper fixing roller 41, the oil regulating blade 64 is separated from the oil coating roller 63. When outputs of the thermistors 71 and 71a provided for detecting the temperatures of the fixing rollers 41 and 42 are reached at predetermined values, each heater UH, LH is turned off, and when the temperatures of the fixing rollers 41 and 42 are reached at predetermined values, the main motor is turned off to complete the warm-up actions.

At the warm-up time, the oil feeding rollers 61, 62 and the oil coating roller 63 are driven by a driving mechanism 101 with the drive of the main motor. However, since some time is required for the oil to reach the oil coating roller 63 through the oil feeding rollers 61, 62, it is preferable to delay the oil regulating blade 64 to be brought in contact with the oil coating roller 63 until the oil reaches the oil coating roller 63 after the oil feeding rollers 61, 62 and the oil coating roller 63 are started to rotate so that unnecessary friction may be avoided.

On the other hand, the time when the surface of the upper fixing roller 41 sticks to the thermistor 71 and generate an abnormal sound is delayed from the time the fixing rollers 41, 42 are started to rotate. In the case when the oil coating time is further delayed, it is preferable to delay the start of rotation of the fixing rollers 41, 42 at the warm-up time by the time delayed.

An oil coating operation at the time when a toner image is fixed onto a recording material effectively prevents the toner on the recording material from being offset onto the upper fixing roller 41. As illustrated in FIG. 13, when a print switch is turned on, a main motor is started to rotate to perform a copying operation. At the time when a recording material thrusts into the nip section between the upper fixing roller 41 and the lower fixing roller 42, oil coating onto the upper fixing roller 41 by the oil coating roller 63 is controlled so as to have the leading end of the oil coated on the upper fixing roller 41 reach the nip section. The oil coated on the upper fixing roller 41 thus reaches the nip section simultaneously with the arrival of the recording material thereto so that toner offset as well as wasteful oil consumption can be avoided.

Judgment on a recording material whether it is a plain paper or an OHP film is made by an optical sensor 122 provided in the transfer drum 25. Basing on this judgment, an oil coating time onto the upper fixing roller 41 by the oil coating roller 63 is changed. This is because the speed of the fixing roller 41 is changed which will be described later. In other words, an oil coating time required for the plain paper is $t_2$, while the time required for the OHP film is $t_3$. The oil coating time is varied according to the size of recording material. More particularly, the oil coating operation is stopped so as to have the rear end of the oil which is coated on the upper fixing roller 41 reach the nip section at the time when the rear end of a recording material passes through the fixing rollers 41, 42.

The oil regulating blade 64 is controlled to be pressed in contact with the oil regulating roller 63 as sown in FIGS. 12 and 13. As shown in FIG. 13, for instance, the oil regulating blade 64 is brought in contact with the oil coating roller 63 at a predetermined time after a recording material is detected by the sensor 121 in the suction section. Under the state, the oil regulating roller 63 is idled for a predetermined time of $t_A$. At this time, the foreign substances such as paper powder stuck to the surface of the oil coating roller 63 is collected by the oil regulating blade 64 together with excessive oil on the surface of the oil coating roller 63 in the location where the oil regulating blade 64 is in contact with the oil coating roller 63. The collected foreign substances are thus covered by oil gathered in the same location. After the oil coating roller 63 is idled, the oil coating roller 63 is brought in contact with the upper fixing roller 41 and an oil coating operation is performed by the oil coating roller 63. When the oil coating operation is completed, the oil coating roller 63 is moved away from the upper fixing roller 41, and then, the oil coating roller 63 is idled for a predetermined time of $t_B$ under the state that the oil regulating blade 64 is in contact with the oil coating roller 63. By this idling, the foreign substances such as paper powder stuck to the surface of the oil coating roller 63 is finally removed. Thereafter, the oil regulating 64 is moved away from the oil coating roller 63.

At this stage, the oil collected in a location on the oil coating roller 63 and the foreign substances covered by the oil thereat are rotated together with the rotation of the oil coating roller 63 and carried into the oil tank 365 through the oil feeding rollers 61, 62. The foreign substances stuck to the edge of the oil regulating blade 64 are flowed into the oil tank with the oil collected when the oil regulating blade 64 is moved away from the oil coating roller 63. After all, the foreign substances on the oil coating roller 63 and the foreign substances stuck to the edge of the oil regulating blade 64 are removed together with the oil. The predetermined times $t_A$ and $t_B$ are the time in which the oil regulating roller 63 is rotated one to several turns.

As shown in FIG. 3, the driving mechanism 101 of the oil feeding rollers 61, 62 and the oil coating roller 63 is provided with gears 102–104 which are connected with the rollers 61, 63 at each one end thereof and a driven gear 105 directly connected to the other end of the oil coating roller 63 which is positioned uppermost. In three of the gears 102–104, oil is circulated starting from the lowermost gear 102 which is impregnated in oil, and therefore, when an external driving gear is engaged with any one of the gears, the oil is also circulated onto the external driving gear to cause the oil to drop outside.

A passive gear 105 is therefore directly connected to the uppermost roller 63 to which the rotation of a driving gear 106 which is driven by the main motor is transmitted through a driving shaft 107 and a gear train 108. Since the transmission system extending from the driving gear 106 to the gear train 108 is positioned above oil, the oil which circulates in the connecting gears 102–104 is prevented from being leaked out through the driving system.

Cleaning rollers 43, 44 which are pressed in contact with respective fixing rollers 41, 42 are required to remove toner and paper powder gradually stick to the surfaces of the upper and lower fixing rollers 41, 42 without damaging the smooth surface of the upper fixing roller 41 especially. It is preferable to design a cleaning material which can avoid generation of any foreign substance such as fallen hair which causes irregularity in coating process.

As conventional cleaning members, cleaning web, mold releasing agent containing roller, mold releasing agent impregnated roller and the like have heretofore been utilized. A fiber which is used on the surface of these cleaning members is thick in diameter and is easily dropped off. Particularly, when the surface is as smooth as, for instance, $R_2$m like the upper fixing roller 41, such fiber as nonwoven fabric which has hitherto been utilized tends to damage the surface of the roller. If, however, a resin or the like is excessively added between the fibers in order to avoid falling hair, a cleaning capability is lost.

Figure 6:
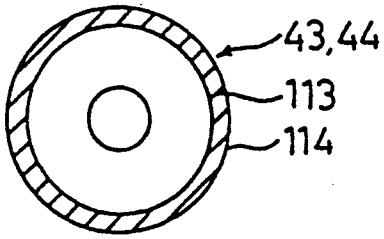
FIG. 6 is a cross-sectional view showing an example of structure of a cleaning roller which is utilized in the fixing device.

As shown in FIG. 6, in the present embodiment, the cleaning rollers 43, 44 are consisted of a roller wick body 113 and a cleaning surface material 114, and the roller wick body 113 is formed in a cylindrical body made of a metal or a heat-proof resin. The cleaning surface material 114 is wound by Miracle or Ecsaine (brand name: manufactured by Torei Co., Ltd.). In short, it is preferable to use nonwoven fabric or woven fabric which is mainly constructed by polyester fiber of under a diameter of 5 μm as a material to be used on the surface of cleaning member.

Figure 7:
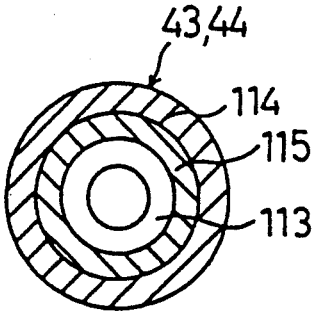
FIG. 7 is a cross-sectional view showing an example of structure of another cleaning roller.

As illustrated in FIG. 7, when an intermediate elastic body 115 is used between the roller wick body 113 and the cleaning surface material 114 for the cleaning rollers 43, 44, the friction between the rollers 41 and 42 is reduced to improve the cleaning capability. As an intermediate elastic body 115, it may be preferable to construct it with silicone rubber, fluoro rubber, silicone sponge and the like.

In the fixing device of the present embodiment, a fixing speed which corresponds with a rotational speed of the fixing roller and a system speed which corresponds with a rotational speed of the photoconductor may be varied. More particularly, when a color image forming operation is performed, a fixing speed is set at one half of the system speed in order to fully compose different colored toners. When a toner image is fixed onto a OHP film, the fixing speed is set at one fourth of the system speed in order to form a highly light transmissible image. Further, at the warm-up time immediately after the power is applied and when a single colored image is formed, the fixing speed is set equal to the system speed in order to avoid the delay in operation.

Figure 8:
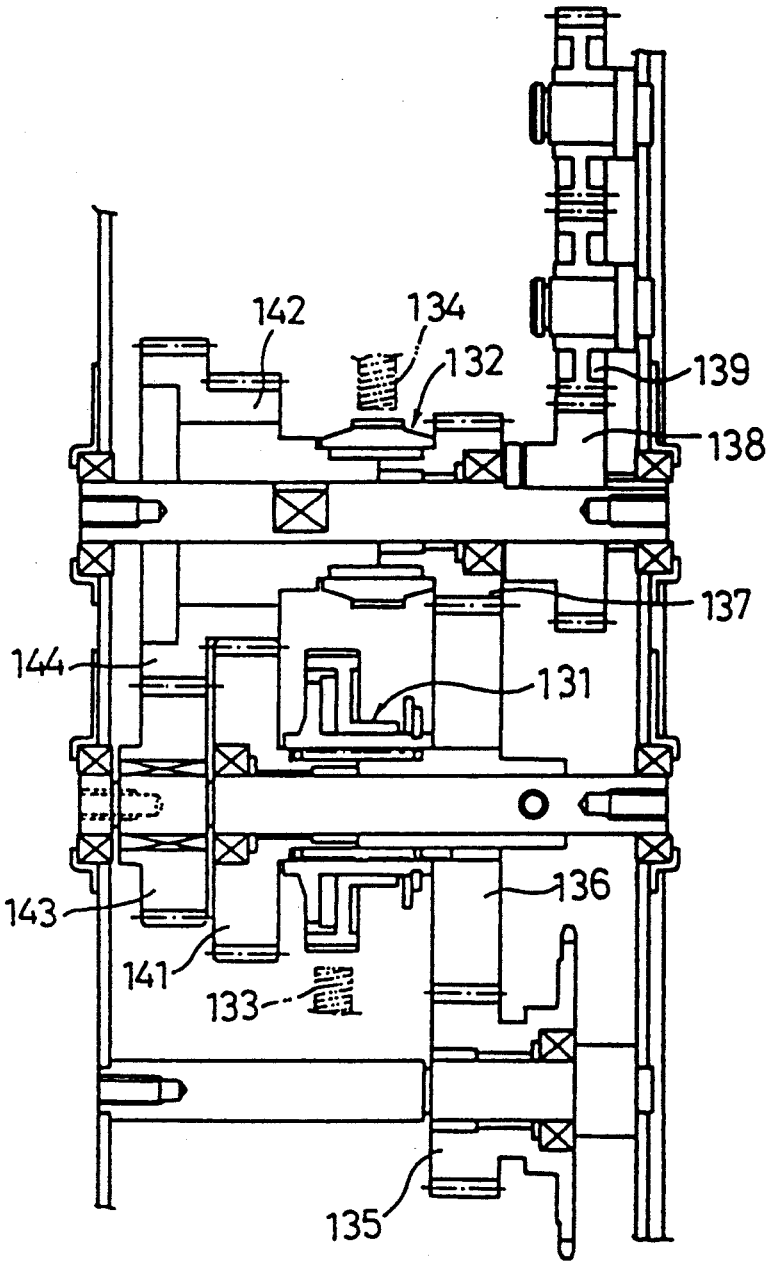
FIG. 8 is a cross-sectional view showing a speed change-over structure of the fixing device.

The change of fixing speed is performed by changing the speed of transport belt 33 which is provided for feeding a recording material with the speed of the fixing device 40. As illustrated in FIG. 8, a variable speed gear for changing a speed is provided with two of spring clutches 131 and 132, and clutch control claws 133 and 134 for controlling the clutches. The clutch control claws 133 and 134 are operated by an unillustrated solenoid. A normal open type clutch is used for the spring clutch 131, while for the spring clutch 132, a normal closed type clutch is used.

When the spring clutches 131 and 132 are under the normal state, the driving force from the main motor is transmitted to gears 138, 139 through gears 136, 137, and then supplied to the fixing device 40 and the transport belt 33. At this stage, the fixing speed is equal to the system speed.

In the case when a recording material is a plain paper, the clutch control claws 133 and 134 are engaged with the spring clutches 131 and 132, and the spring clutch 131 is placed under a closed state and the spring clutch 132 is placed under an open state respectively. Under the state, the driving force from the main motor is transmitted to the gears 138, 139 through the gears 136, 141, 143 to be supplied to the fixing device 40 and the transport belt 33. At this stage, the fixing speed is one half of the system speed.

In the case when a recording material is an OHP film, only the clutch control claw 134 is engaged with the spring clutch 132, and the spring clutch 131 is placed under an open state and the spring clutch 132 is placed under an open state respectively. Under the state, the driving force from the main motor is transmitted to the gears 138, 139 through the gears 136, 132, 144 to be supplied to the fixing device 40 and the transport belt 33. At this stage, the fixing speed is one quarter of the system speed.

In the case when a fixing speed differs from a system speed, a recording material has to be transported at a fixing speed after the recording material has passed through the transfer position where a toner image has been transferred from the photoconductor. Accordingly, the distance from the transfer position to the fixing device has to be longer than the maximum size of recording material. On the other hand, in order to construct a copying machine smaller in size, it is necessary to perform the above-mentioned change of fixing speed when the leading end of a recording material has approached nearby the fixing device. However, due to mechanical or electrical factors of the variable change gear, it is inevitable to avoid an instability in the fixing speed when the speed is changed. Unstable state of the fixing speed does not largely affect the transport of a plain paper, however, it largely affects the transport of an OHP film. In other words, when the fixing rollers are rotated with unstable speed, it obstructs the OHP film to thrust thereinto. Such a phenomenon remarkably happens particularly to the fixing device in which oil coating is performed.

In the present embodiment, when a recording material 56 is transported to the fixing device 40, the speeds of the transport belt 33 and the fixing rollers 41, 42 are changed corresponding to the fixing speed previously set. The change of speed is controlled basing on the signal from a sensor 121 (refer to FIG. 1) provided adjacent to the transport belt 33. The time for changing a fixing speed of an OHP film is set earlier than that of a plain paper.

More particularly, as illustrated in FIG. 13, in the case of a plain paper, the clutches 131, 132 are operated at a predetermined time $t_4$ after a signal is output from the sensor 121 to perform the change of speed from a system speed to a fixing speed. And, after the time required for a recording material to pass through the fixing device has elapsed, the speed is returned to the system speed again.

In the case of an OHP film, an optical sensor 122 provided in the transfer drum 25 detects that a recording material is a transparent OHP film. Basing on this detection, only the clutch 132 is operated at a predetermined time $t_5$ after a signal is output from the sensor 121 to perform the change of speed from a system speed to a fixing speed. And, after the time required for a recording material to pass through the fixing device has elapsed, the speed is returned to the system speed again.

Since the time $t_5$ is shorter than the time $t_4$, the time for changing a fixing speed of the OHP film becomes earlier than that of the plain paper. The difference $t_6$ between the time $t_4$ and $t_5$ is a time sufficient fixing speed to become a stabilized low speed, which is something around 1.5 seconds.

Figure 9:
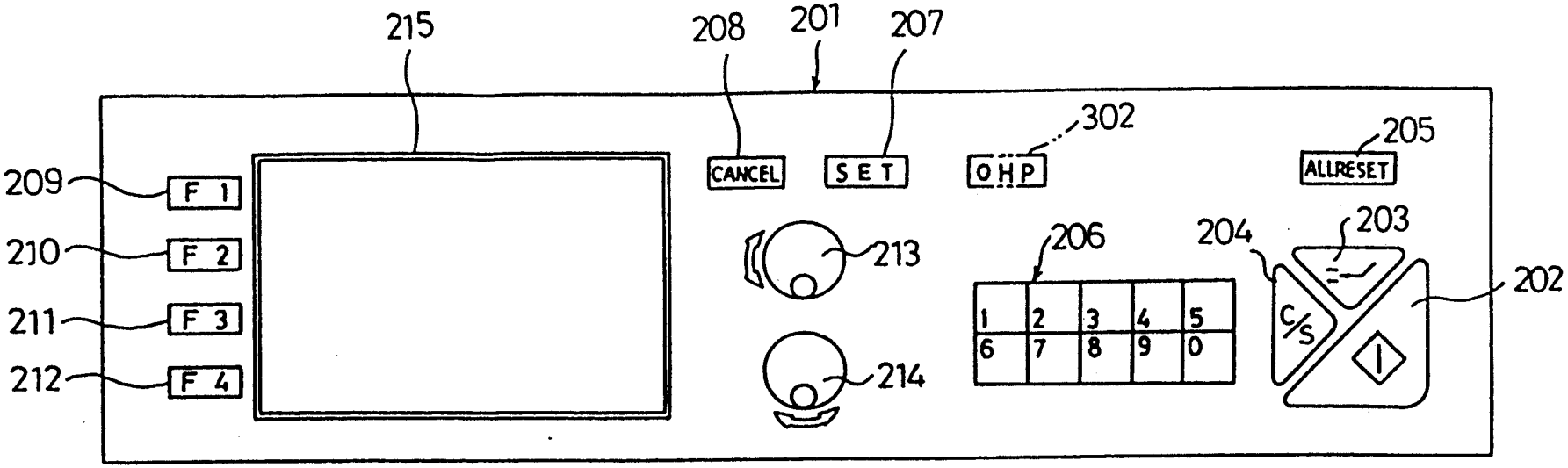
FIG. 9 is a front view of an operation panel of a copying machine.
Figure 10:
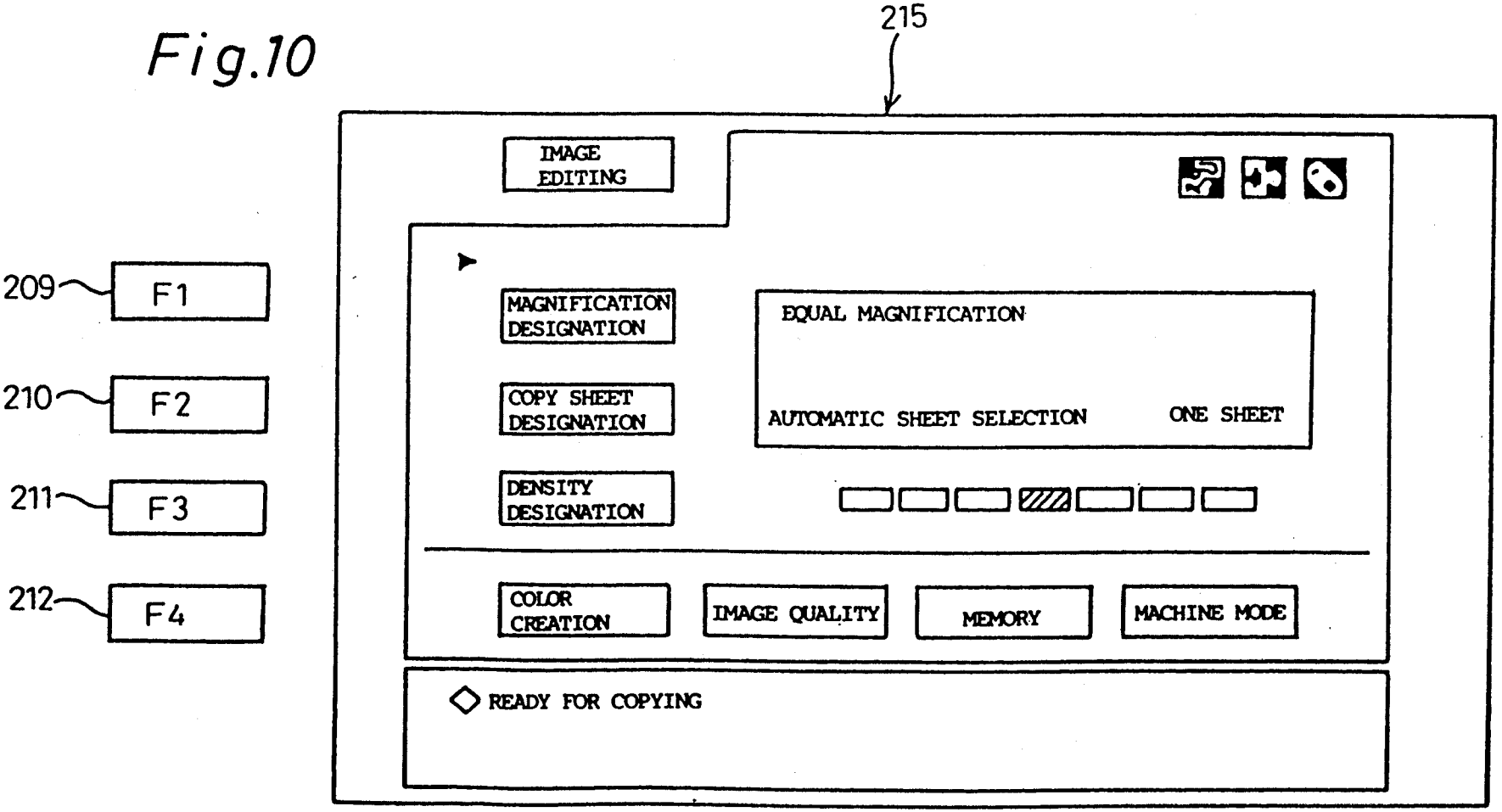
FIG. 10 is a detail view showing a part of the operation panel.

FIGS. 9 and 10 show an entire and a partially enlarged views of an operation panel 201 provided in the copying machine 1.

In the operation panel 201 illustrated in FIG. 9, there are provided a print key 202 for starting a copying operation, an interruption key 203 for designating an interruption of copying operation, a clear/stop key 204, an all reset key 205, ten keys 206, a set key 207, a cancel key 208, various function keys 209–212, jog dial keys 213, 214 for designating a region when masking is conducted, and an indicating section 215 consisted of liquid crystal for indicating an original image to set a region and for indicating various messages. The function keys 209–212 perform magnification designation, sheet designation, density adjustment and the like.

FIG. 10 shows an example how indication is made in the indicating section 215. When the function key 209 is pressed, it becomes a magnification designation mode, when the function key 210 is pressed, it becomes a sheet designation mode, and when the function key 211 is pressed, it becomes a density adjustment mode respectively. In the case of the sheet designation mode, for instance, sizes A3, B4, A4, B5 are indicated corresponding to the function keys 209–212 and it becomes possible to select a size of sheet by the function keys.

Figure 11:
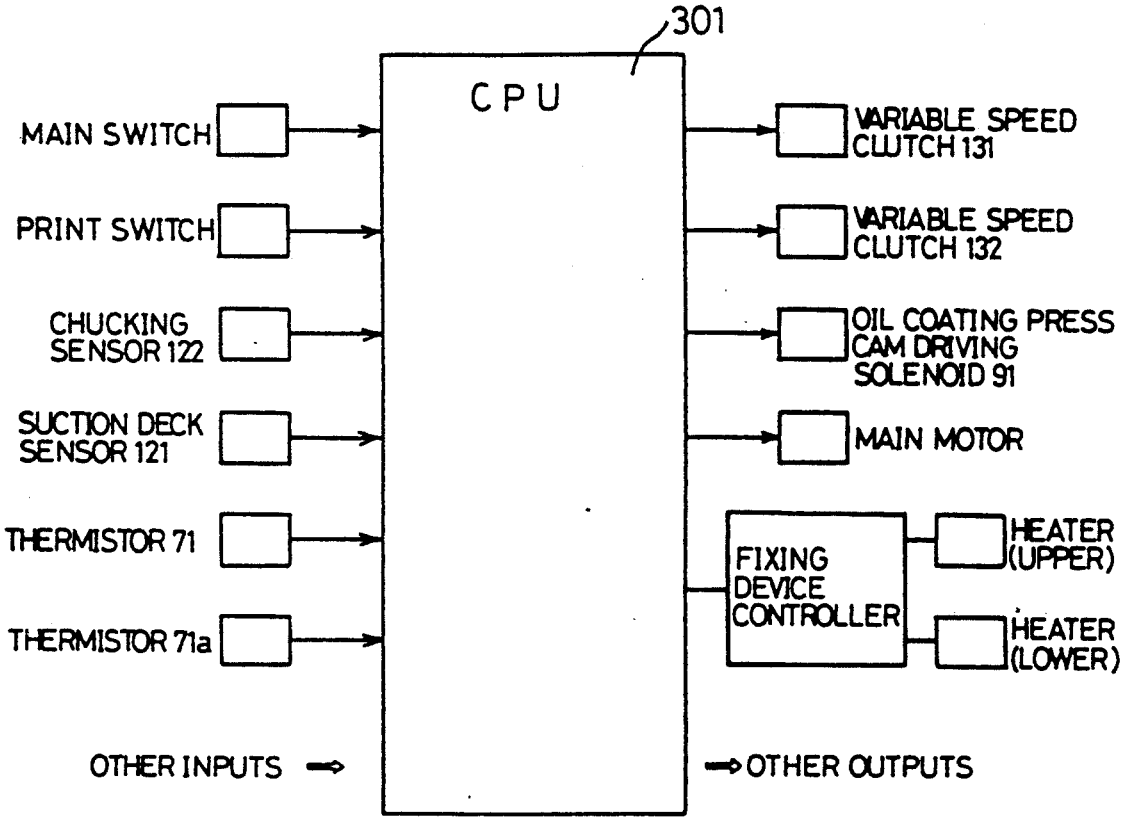
FIG. 11 is a block diagram showing a control circuit of a copying machine.

FIG. 11 is a block diagram of a control circuit which controls the above-mentioned various actions. Each input and output element described above is connected to CPU 301, and the fixing device is controlled according to the time charts in FIGS. 12 and 13.

It may also be arranged to use an OHP film by operating a mode designation key 302 provided in the operation panel 201, not relying on the detection by a chucking sensor.

In the present embodiment, it is arranged to operate the oil coating mechanism for a predetermined period of time at the warm-up time after the power is applied. However, in the case when the power is applied again comparatively in an earlier time after the preceding operation, the temperature of the fixing rollers is not lowered much, and therefore, oil is lubricated by its bleeding. In such a case, an oil coating process may be omitted by the information given on the temperature of the fixing rollers. Conversely, it is preferable to perform the oil coating process when the temperature of the fixing rollers is lower than a predetermined value and warming up is conducted even when the machine is reoperated after solving a trouble.

In the present embodiment, the oil feeding rollers 61, 62 and the oil coating roller 63 are driven by the driving mechanism 101 when the main motor is driven, however, it may also be arranged to drive them for only a period of time they need to be driven by providing the driving mechanism 101 with a clutch or the like. In this case, the oil feeding rollers 61, 62 and the oil coating roller 63 are started to rotate simultaneously with the timing the fixing rollers are driven a predetermined time $t_C$ before the timing oil is to be coated. After a predetermined time $t_D$ has elapsed from the time the oil feeding rollers 61, 62 and the oil coating roller 63 were started to rotate, the oil regulating blade 64 is brought in contact with the oil coating roller. The predetermined time $t_D$ is the time sufficient for the oil in the oil tank to reach a location of contact with the oil coating roller 63 and the oil regulating blade 64. Thereafter, the oil coating roller 63 is idled for a period of time $t_A$ so that the oil on the oil coating roller 63 is sufficiently leveled Then, after the oil regulating roller 63 is idled, the oil regulating roller 63 is brought in contact with the upper fixing roller 41 to perform an oil coating operation.

Although the present invention has been fully described by way of examples with reference to the accompanying drawings, it is to be noted that various changes and modifications will be apparent to those skilled in the art. Therefore, unless otherwise such changes and modifications depart from the scope of the present invention, they should be construed as being included therein.

What is claimed is:

1. A fixing device for fixing a toner image onto a sheet, comprising:

a pair of fixing rollers for fixing a toner image onto a sheet passing between the pair of rollers by giving heat, one of the fixing rollers being provided with a layer of an elastic body, and the surface of this roller is substantially a mirror plane;

mold releasing agent coating member for coating a mold releasing agent on said one of the fixing rollers;

warm-up means for executing a warm-up operation of said fixing rollers, said warm-up means including detecting means, which is in contact with said one of the fixing rollers, for detecting the temperature thereof, said warm-up means starting a warm-up operation in response to a power-on and terminating when the fixing rollers reach a predetermined temperature, and said warm-up operation including rotation of said fixing rollers; and control means for operating the mold releasing agent coating means for a predetermined time during a warm-up time, wherein said control means terminates the operation of the mold releasing agent coating means before the termination of said warm-up operation.

2. The fixing device as defined in claim 1, wherein the mold releasing agent coating means is provided with a movable coating member between a first position where the mold releasing agent coating means contacts said one of the fixing rollers and a second position where it is separated from said one of the fixing rollers, and driving means for moving the coating member.

3. The fixing device as defined in claim 1, wherein said one of the fixing rollers contacts a toner image on a sheet.

4. The fixing device as defined in claim 1, wherein said one of the fixing rollers incorporates a heater therein.

5. A fixing device for fixing a toner image onto a sheet, comprising:

a pair of fixing rollers for fixing a toner image onto a sheet passing between the pair of rollers by giving heat, one of the fixing rollers being provided with a layer of an elastic body, and the surface of this roller is substantially a mirror plane;

mold releasing agent coating member for coating a mold releasing agent on said one of the fixing rollers; and control means for operating the mold releasing agent coating means at a warm-up time;

wherein the mold releasing agent coating means is provided with an accommodating section for accommodating a mold releasing agent, a first roller which contacts the mold releasing agent in the accommodating section, a second roller which contacts the first roller, a third roller which contacts the second roller, the third roller being movably provided between a first position where the third roller contacts said one of the fixing rollers and a second position where it is separated from said one of the fixing rollers.

6. The fixing device as defined in claim 5, wherein the mold releasing agent coating means is provided with regulating means for regulating the amount of the mold releasing agent on the third roller.

7. The fixing device as defined in claim 6, wherein the regulating means is movably provided between a regulating position where the regulating means contacts the third roller and a retracting position where it is separated from the third roller.

8. A fixing device for fixing a toner image onto a sheet, comprising:

a pair of fixing rollers for fixing a toner image onto a sheet passing between the pair of rollers by giving heat;

driving means for rotatively driving the pair of fixing rollers selectively at one of three driving speeds, V1, V2 and V3, where $V1>V2>V3$;

judging means for judging a sheet whether the sheet is a plain paper or a specific sheet;

signal generating means for generating a switching signal; and control means for switching rotational speed of the fixing roller from V1 to V2 before a plain paper arrives between the pair of rollers while switching rotational speed of the fixing roller from V1 to V3 before a specific sheet arrives between the pair of rollers in response to the judging means, said control means switching rotational speed of the fixing roller from V1 to V2 after a first predetermined time T1 from a generation of said switching signal while switching rotational speed of the fixing roller from V1 to V3 after a second predetermined time T2 from a generation of said switching signal, where $T1>T2$.

9. The fixing device as defined in claim 8, wherein the driving means includes a variable speed gear mechanism.

10. The fixing device as defined in claim 8, wherein the judging means includes a sensor for detecting a sheet.

11. The fixing device as defined in claim 8, further comprising mold releasing agent coating means for coating a mold releasing agent on said one of the fixing rollers.

12. The fixing device as defined in claim 11, wherein the mold releasing agent coating means is provided with a movable coating member between a first position where the mold releasing agent coating means contacts said one of the fixing rollers and a second position where it is separated from said one of the fixing rollers, and driving means for moving the coating member.

13. The fixing device as defined in claim 8, wherein said signal generating means includes a sheet sensor which detects a sheet coming to the pair of rollers and generates the switching signal.

14. The fixing device as defined in claim 8, further comprising:

means for transporting a sheet having a toner image thereon toward the pair of fixing rollers, driving speed of said transporting means being substantially same to that of said fixing rollers.

15. The fixing device as defined in claim 14, wherein said driving means drives said transporting means.

16. A fixing device for fixing a toner image onto a sheet, comprising:

a pair of fixing rollers for fixing a toner image onto a sheet passing between the pair of rollers by giving heat;

driving means for rotatively driving the pair of fixing rollers;

judging means for judging a sheet whether the sheet is a plain paper or a transparent film;

control means for controlling the driving means so as to change rotational speed of the fixing rollers in response to the judging means, the timing for changing rotational speed when the sheet is a transparent film is earlier than that when the sheet is a plain paper; and mold releasing agent coating means for coating a mold releasing agent on said one of the fixing rollers;

wherein the mold releasing agent coating means is provided with an accommodating section for accommodating a mold releasing agent, a first roller which contacts the mold releasing agent in the accommodating section, a second roller which contacts the first roller, a third roller which contacts the second roller, the third roller being movably provided between a first position where it contacts said one of the fixing rollers and a second position where it is separated from said one of the fixing rollers.

17. The fixing device as defined in claim 16, wherein the mold releasing agent coating means is provided with a regulating means for regulating the amount of a mold releasing agent on the third roller.

18. The fixing device as defined in claim 16, wherein the regulating means is movably provided between a regulating position where the regulating means contacts the third roller and a retracting position where it is separated from the third roller.

19. A fixing device for fixing a toner image onto a sheet, comprising:

a pair of fixing rollers for fixing a toner image onto a sheet passing through between the pair of rollers by giving heat;

a mold releasing agent coating member for coating a mold releasing agent on one of the fixing rollers, being movably provided between a first position where it contacts said one of the fixing rollers and a second position where it is separated from said one of the fixing rollers;

a regulating member for regulating the amount of the mold releasing agent on the mold releasing agent coating member, being movably provided between a regulating position where the regulating member contacts the mold releasing agent coating member and a retracting position where it is separated from the mold releasing agent coating member; and control means for moving the mold releasing agent coating member to the first position after the regulating member is, moved to the regulating position.

20. The fixing device as defined in claim 19, wherein the mold releasing agent coating member is a roller.

21. The fixing device as defined in claim 19, wherein the regulating member is a blade.

22. The fixing device as defined in claim 19, wherein the control means moves the mold releasing agent coating member to the first position so as to have a first coated mold releasing agent coated on said one of the fixing rollers reaches a nip section between the pair of the fixing rollers simultaneously with the timing a sheet thrusts into the nip section.

23. The fixing device as defined in claim 19, wherein the control means moves the mold releasing agent coating member to the first position for only a predetermined period of time during the fixing rollers are rotated at a warm-up time.

24. The fixing device as defined in claim 19, further comprising mold releasing agent transmitting means for transmitting the mold releasing agent accommodated in the accommodating section, being provided with a first roller which contacts the mold releasing agent in the accommodating section and a second roller which contacts the first roller and the mold releasing agent coating member.

25. The fixing device as defined in claim 19, wherein said one of the fixing rollers contacts a toner image on a sheet.

26. The fixing device as defined in claim 19, wherein said one of the fixing rollers incorporates a heater therein.

27. The fixing device as defined in claim 19, wherein said one of the fixing rollers is provided with a layer of an elastic body, and the surface is substantially a mirror plane.

28. A fixing device for fixing a toner image onto a sheet, comprising:

a pair of fixing rollers for fixing a toner image onto a sheet passing through between the pair of rollers by giving heat;

a rotatable mold releasing agent coating roller for coating a mold releasing agent on one of the fixing rollers, being movably provided between a first position where it contacts said one of fixing rollers and a second position where it is moved away therefrom;

a regulating member for regulating the amount of the mold releasing agent on the mold releasing agent roller, being movably provided between a regulating position where it contacts the mold releasing agent coating roller and a retracting position where it is moved away therefrom; and control means for rotating the mold releasing agent coating roller for a predetermined period of time during the mold releasing agent coating roller is moved to the first position after the regulating member is moved to the regulating position.

29. The fixing device as defined in claim 28, wherein the regulating member is a blade.

30. The fixing device as defined in claim 28, wherein the control means moves the mold releasing agent coating roller to the first position so as to have a first coated mold releasing agent coated on said one of the fixing rollers reaches a nip section between the pair of fixing rollers simultaneously with the timing a sheet thrusts into the nip section.

31. The fixing device as defined in claim 28, further comprising mold releasing agent transmitting means for transmitting the mold releasing agent accommodated in the accommodating section onto the mold releasing agent coating roller, being provided with a first roller which contacts the mold releasing agent in the accommodating section and a second roller which contacts the first roller and the mold releasing agent coating roller.

32. A fixing Device for fixing a toner image onto a sheet, comprising:

a pair of fixing rollers for fixing a toner image onto a sheet passing through between the pair of rollers by giving heat;

a rotatable mold releasing agent coating roller for coating a mold releasing agent on one of the fixing rollers, being movably provided between a first position where it contacts said one of the fixing rollers and a second position it is moved away therefrom;

a regulating member for regulating the amount of the mold releasing agent on the mold releasing agent coating roller, being movably provided between a regulating position where it contacts the mold releasing agent coating roller and a retracting position where it is moved away therefrom;

control means for rotating the mold releasing agent coating roller for a predetermined period of time under the state that the mold releasing agent coating roller is moved from the first position to the second position with the regulating member positioned at the regulating position.

33. The fixing device as defined in claim 32, wherein the regulating member is a blade.

34. The fixing device as defined in claim 32, wherein the control means moves the mold releasing agent coating roller to the first position so as to have a first coated mold releasing agent coated on said one of the fixing roller reaches a nip section between the pair of fixing rollers simultaneously with the timing a sheet thrusts into the nip section.

35. The fixing device as defined in claim 32, further comprising mold releasing agent transmitting means for transmitting the mold releasing agent accommodated in the accommodating section onto the mold releasing agent coating roller, being provided with a first roller which contacts the mold releasing agent in the accommodating section and a second roller which contacts the first roller and the mold releasing agent coating roller.

36. A fixing device for fixing a toner image onto a sheet, comprising:

a pair of fixing rollers for fixing a toner image onto a sheet passing through between the pair of rollers by giving heat;

a rotatable mold releasing agent coating roller for coating a mold releasing agent on one of the fixing rollers, being movably provided between a first position where it contacts said one of the fixing rollers and a second position where it is separated from said one of the fixing rollers;

mold releasing agent transmitting means for transmitting the mold releasing agent accommodated in the accommodating section onto the mold releasing agent coating roller;

driving means for rotatively driving the mold releasing agent coating roller;

a regulating member for regulating the amount of the mold releasing agent on the mold releasing agent coating roller, being movably provided between a regulating position where it contacts the mold releasing agent coating roller and a retracting position where it is moved away therefrom; and control means for moving the regulating member to the regulating position after a predetermined time from the time the mold releasing agent coating roller started rotation.

37. The fixing device as defined in claim 36, wherein the regulating means is a blade.

38. The fixing device as defined in claim 36, wherein the control means moves the mold releasing agent coating roller to the first position after a predetermined time from the time the regulating member has been moved to the regulating position.

39. The fixing device as defined in claim 36, wherein the mold releasing agent transmitting means is provided with a first roller which contacts the mold releasing agent in the accommodating section and a second roller which contacts the first roller and the mold releasing agent coating roller.

40. A fixing device for fixing a toner image onto a sheet, comprising:

a pair of fixing rollers for fixing a toner image onto a sheet passing between the pair of rollers by giving heat;

driving means for rotatively driving the pair of fixing rollers selectively at one of three driving speeds, V1, V2 and V3, where $V1>V2>V3$;

signal generating means for generating a switching signal;

mode selecting means for selecting one of first and second modes; and control means for switching rotational speed of the fixing roller from V1 to V2 before a sheet arrives between the pair of rollers in the first mode while switching rotational speed of the fixing roller from V1 to V3 before a sheet arrives between the pair of rollers in the second mode, said control means switching rotational speed of the fixing roller from V1 to V2 after a first predetermined time T1 from a generation of said switching signal while switching rotational speed of the fixing roller from V1 to V3 after a second predetermined time T2 from a generation of said switching signal, where $T1>T2$.

* * * * *